United States Patent [19]

Piche et al.

[11] Patent Number: 4,686,883

[45] Date of Patent: Aug. 18, 1987

[54] GUITAR WITH IMPROVED VIBRATO AND TUNING ADJUSTMENT ASSEMBLIES

[76] Inventors: Roland J. Piche, 6755 Yucca St., Apt. 21, Hollywood, Calif. 90028; John W. Carruthers, 3307 Colbert Ave., Los Angeles, Calif. 90066

[21] Appl. No.: 872,887

[22] Filed: Jun. 11, 1986

[51] Int. Cl.[4] ..... G10D 3/12

[52] U.S. Cl. ..... 84/313; 84/297 R; 84/298; 84/304; 84/312 R

[58] Field of Search ..... 84/267, 298, 299, 307, 84/312 R, 313

[56] References Cited

U.S. PATENT DOCUMENTS

| | | | |
|---|---|---|---|
| 2,323,969 | 7/1943 | Biederman | 84/312 R |
| 3,014,395 | 12/1961 | Blair | 84/312 P |
| 3,466,962 | 9/1969 | Cole | 84/312 R |
| 3,971,286 | 7/1976 | Borell | 84/298 |
| 4,170,161 | 10/1979 | Kaftan | 84/312 R |
| 4,457,201 | 7/1984 | Storey | 84/313 |
| 4,475,432 | 10/1984 | Stroh | 84/314 N |

*Primary Examiner*—Lawrence R. Franklin

*Attorney, Agent, or Firm*—Kelly, Bauersfeld & Lowry

[57] ABSTRACT

A string instrument particularly such as a guitar is provided with an improved vibrato assembly to obtain a vibrato/tremolo effect, and further including improved tuning adjustment mechanisms for maintaining the guitar in tune and for rapid adjustment to one of several preset tuning configurations. The vibrato assembly comprises an improved tuning machine and an improved bridge unit respectively on the head and body of the guitar with the guitar strings extended therebetween. The tuning machine and bridge unit support the guitar strings independently with each string under selected tension at a primary tuning set position. At the bridge unit, the strings are supported by individual rocker arms engaged by respective cams which are movable together by a manual spring-loaded control lever to achieve the vibrato/tremolo effect with raised or lowered pitch, as desired, with the cams displacing the rocker arms and thus altering tension individually for each guitar string. The control lever may be locked at one or more alternative tuning set positions to correspondingly lock the guitar in alternative tuning configurations. A tuning selector dial unit may also be provided and includes sets of tuning selector pins engagable with the rocker arms for locking the guitar in additional alternative tuning configurations.

22 Claims, 20 Drawing Figures

FIG. 1
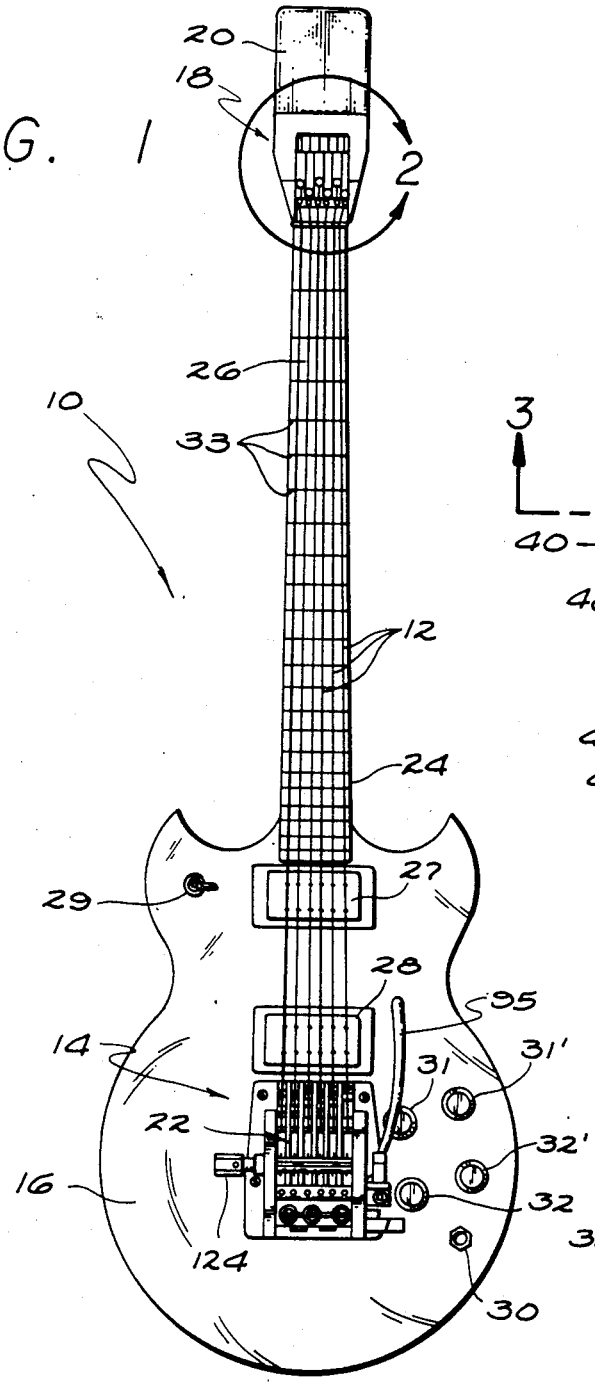
FIG. 2
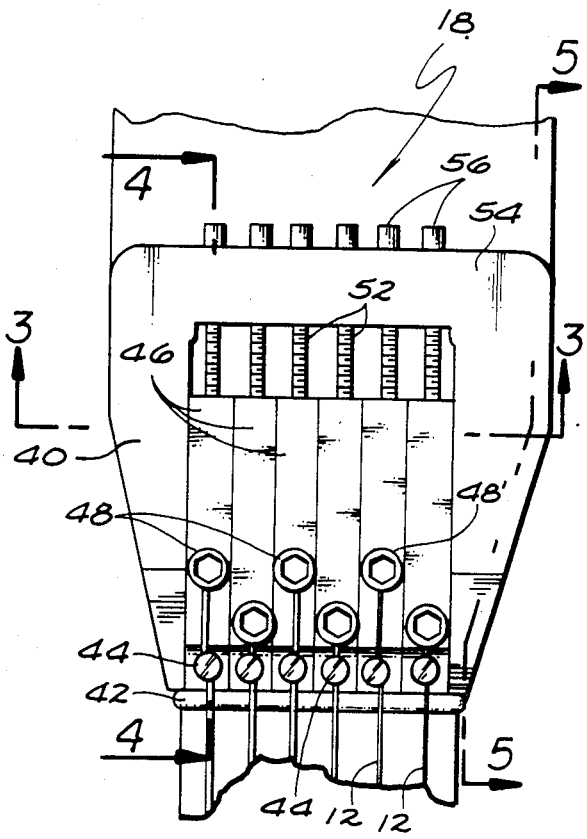
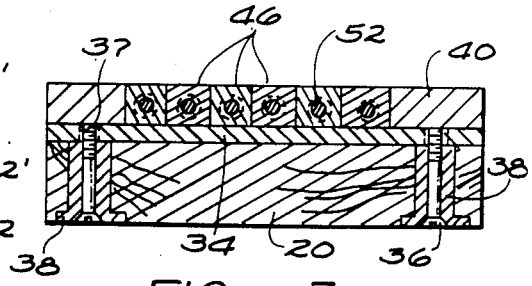
FIG. 3
FIG. 4
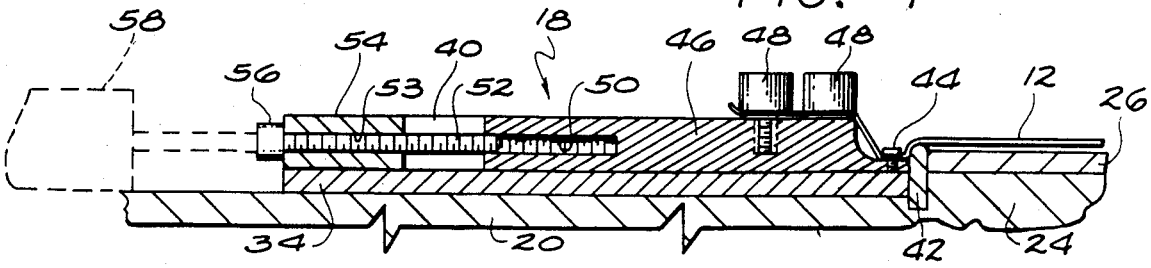

FIG. 15
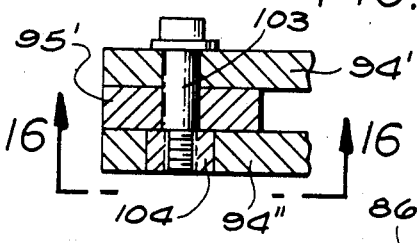
FIG. 14
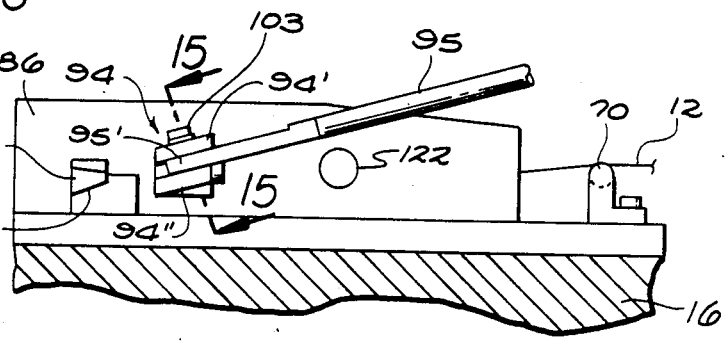
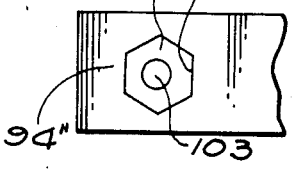
FIG. 16
FIG. 17
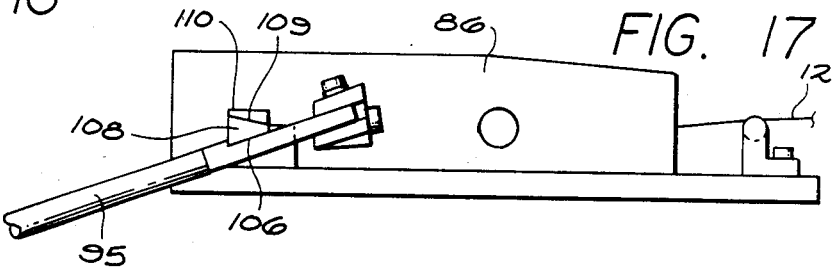
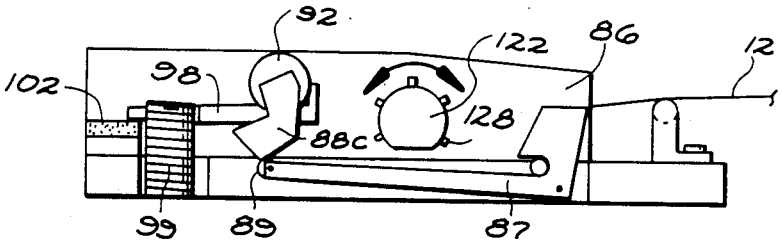
FIG. 18
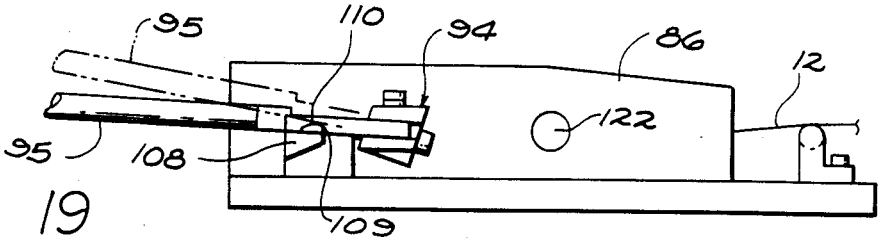
FIG. 19
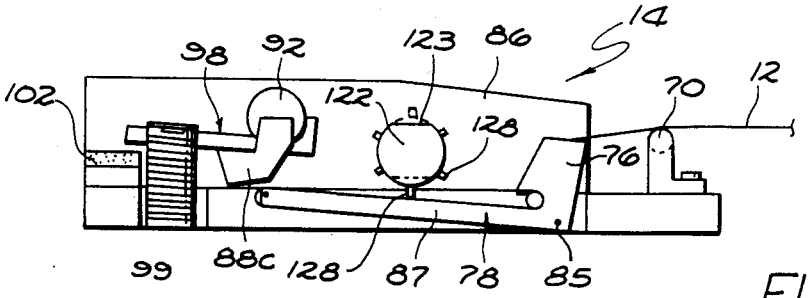
FIG. 20

GUITAR WITH IMPROVED VIBRATO AND TUNING ADJUSTMENT ASSEMBLIES

BACKGROUND OF THE INVENTION

This invention relates generally to improvements in string instruments particularly such as a guitar. More specifically, this invention relates to an improved vibrato assembly for installation onto a guitar, wherein the vibrato assembly is adapted for use with improved tuning adjustment mechanisms for maintaining the guitar in tune and permitting rapid adjustment to alternative preset tuning configurations.

The guitar is a well known and popular musical instrument belonging to the so-called string instrument family. More specifically, the guitar commonly comprises a lightweight body joined to an elongated neck, with a plurality of guitar strings supported under tension between a bridge assembly on the guitar body and a tuning machine on a head at the distal end of the guitar neck. The tensioned strings are plucked or strummed to produce selected musical notes and/or chords. The effective lengths of the individual strings may be varied by manually pressing the strings against the guitar neck at selected positions longitudinally along the neck to alter the note or chord being played. The tuning machine includes means for adjusting the tension on the guitar strings to select the relative tuning configuration of the strings.

In the past, the tuning machine and bridge assembly of a guitar have traditionally supported the strings in a relatively balanced or equilibrium condition when the guitar is properly tuned. That is, the total tension force acting upon any one of the guitar strings is dependent at least in part upon the tension forces acting upon the remaining strings of the guitar. Accordingly, adjustment in tension of any single string results in at least some alteration in the tension acting upon the remaining strings whereby initial tuning of the several guitar strings can be a relatively tedious process requiring a significant degree of musical expertise. Moreover, in the event of breakage of a single guitar string, it becomes necessary to retune all of the strings relative to each other when a replacement string is installed.

When properly tuned, however, the guitar is a highly versatile and thus extremely popular musical instrument which can be used to play many different styles of music in different musical keys. Unfortunately, however, many guitar musicians lack sufficient training to utilize the full range of capabilities afforded by the guitar. Instead, many guitar musicians have the skill to play only a small number of basic chords in a single or limited number of musical keys. Such persons are unable to accommodate occasions requiring alternative keys or alternative tuning configurations of the guitar.

In addition, some guitar styles have been provided with vibrato apparatus to achieve a controlled tremolo effect with selected notes or chords. Such vibrato apparatus has been used, for example, with so-called electric guitars of the type having electromagnetic means for sensing and amplifying guitar string vibrations. Such vibrato devices are typically incorporated into the guitar bridge assembly and include a lever moved manually by the musician to stretch or shorten all of the strings by uniform displacements with a resultant increase or decrease in output pitch. However, this movement of the strings as a group results in a significantly nonuniform variation in string pitch due to the vastly different and nonlinear pitch variation characteristics for guitar strings of different gauge and/or subjected to different tension forces. Accordingly, use of the vibrato apparatus has inherently moved the strings to an out-of-tune configuration. Moreover, with traditional knife-edge type string support mechanisms, it is extremely difficult to insure accurate string return to the selected initial tuning configuration when the vibrato lever is released.

There exists, therefore, a significant need for improvements to the vibrato and tuning adjustment assemblies of a guitar. More specifically, there exists a need for tuning adjustment assemblies which will accommodate individual and independent string tension adjustment to a selected tuning configuration and which can be used with a vibrato assembly without tuning instabilities. Moreover, there exists a need for adjustable tuning mechanisms for rapidly adjusting the guitar between a plurality of different preset tuning configurations, thereby permitting a musician with limited ability to play the guitar in a variety of different musical keys. The present invention fulfills these needs and provides further related advantages.

SUMMARY OF THE INVENTION

In accordance with the invention, an improved vibrato assembly and improved tuning adjustment mechanisms are provided for mounting onto a guitar. The vibrato assembly includes a control lever movable by the musician for displacing the guitar strings through individually selected increments to increase or decrease string tension, thereby increasing or decreasing output pitch as desired. The tuning adjustment mechanisms provide individualized and independent tuning and/or replacement of the guitar strings and further provide rapid adjustment of the strings to selected preset alternative tuning configurations.

In one preferred form, the guitar includes a plurality of typically six guitar strings suspended and tensioned between a bridge unit on the guitar body and a tuning machine on the guitar head at the distal end of an elongated neck. The strings conventionally overlie the neck and may be depressed by the musician against the neck at selected longitudinal positions to vary the effective lengths of the strings when the guitar is played. The vibrato assembly is incorporated into the bridge unit and includes means for independently supporting the strings which extend therefrom to the tuning machine for independent tension adjustment.

The improved tuning machine on the guitar head includes a plurality of independently adjustable slide blocks secured respectively to the plurality of guitar strings. Tension adjustment means such as adjustment screws are provided for variably positioning the slide blocks relative to a tuning machine frame for individually and independently tuning the guitar strings.

At the bridge unit on the guitar body, the plurality of guitar strings are passed over respective saddle rollers carried on individual support posts each adapted for longitudinal adjustment and locking at a selected, preset position. The strings pass further through upwardly open slots in the ends of individual rocker arms and are seated upon vertically adjustable tuning slugs in the rocker arms, wherein the vertical positions of these tuning slugs further controls string tension particularly during vibrato operation or adjustment to alternative tuning configurations. The ends of the guitar strings terminate in enlarged retention balls seated within rearwardly open notches on the respective rocker arms.

The rocker arms each have a generally L-shaped configuration and are supported by the bridge unit for individual pivoting motion to obtain individual adjustment of guitar string tension. A rearwardly extending lower leg of each rocker arm terminates in a cam follower roller positioned beneath individual cams having individually contoured cam faces. These cams are supported in turn from a control shaft rotated by the control lever to pivot the rocker arms individually in accordance with cam face contour to achieve individually selected increased or decreased guitar string tension. Accordingly, a vibrato/tremolo effect is achieved. A spring-loaded retainer plate returns the control shaft together with the guitar strings to the initial preset tuning configuration when the control lever is released.

To achieve alternative tuning configuration settings, the control lever is pivotally supported by the control shaft for swinging movement into locked engagement with locking lands at one side of the bridge unit. At least one of the locking lands requires further control lever movement to a position increasing guitar string tension, and at least one locking land requires control lever movement to a position decreasing guitar string tension. Accordingly, the control lever may be set rapidly set to one of multiple alternative tuning configurations without requiring any other adjustment of guitar components.

The guitar includes, in the preferred form, a selector dial unit having a multifaceted selector shaft with adjustably preset sets of tuning selector pins. This selector shaft is supported by the bridge unit in a position overlying the plurality of rocker arms. One facet of the selector shaft omits tuning pins to permit unobstructed guitar operation as previously described. However, the remaining shaft facets include the tuning selector pins which protrude from the shaft to engage the underlying rocker arms and limit upward pivoting motion thereof during vibrato operation. Alternately, the tuning selector pins provide stops for locking the rocker arms in selected alternative configurations when the control lever is locked with the locking lands in a position decreasing string tension.

According to still further features of the invention, the bridge unit is conveniently adapted for rapid mounting onto the guitar body by means of mounting screws including height adjustment capabilities. With the construction, the specific height of the guitar strings relative to the underlying guitar body can be individually selected as desired by the individual musician.

Other features and advantages of the present invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a top plan view illustrating a guitar including an improved vibrato assembly and improved tuning mechanisms embodying the novel features of the invention;

FIG. 2 is an enlarged fragmented top plan view corresponding generally with the encircled region 2—2 of FIG. 1;

FIG. 3 is a transverse sectional view taken generally on the line 3—3 of FIG. 2;

FIG. 4 is a fragmented longitudinal sectional view taken generally on the line 4—4 of FIG. 2;

FIG. 14 is a fragmented longitudinal sectional view taken generally on the line 14—14 of FIG. 8;

FIG. 15 is a fragmented sectional view taken generally on the line 15—15 of FIG. 14;

FIG. 16 is a fragmented bottom plan view of a portion of the bridge unit, taken generally on the line 16—16 of FIG. 15;

FIG. 17 is a longitudinal sectional view similar to FIG. 14 but illustrating the bridge unit locked in one alternative tuning configuration;

FIG. 18 is a fragmented longitudinal sectional view similar to FIG. 9 and illustrating the bridge unit in the alternative tuning configuration depicted in FIG. 17;

FIG. 19 is a longitudinal sectional view similar to FIG. 17 but illustrating the bridge unit in other alternative tuning configurations; and FIG. 20 is a longitudinal sectional view similar to FIG. 18 but illustrating a tuning selector dial unit movable to alternative positions of adjustment to obtain additional alternative tuning configurations.

DETAILED DESCRIPTION OF THE PREFERRED EMBODIMENT

Figure 11:
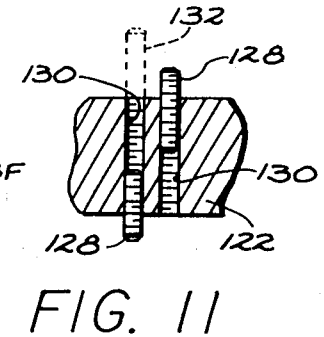
FIG. 11 is a fragmented sectional view taken generally on the line 11—11 of FIG. 9.

As shown in the exemplary drawings, a guitar referred to generally in FIG. 1 by the reference numeral 10 includes a plurality of guitar strings 12 supported in tension between a bridge unit 14 on a guitar body 16 and a tuning machine 18 on a head 20 of the guitar. The bridge unit 14 incorporates an improved vibrato assembly 22 for achieving a controlled vibrato/tremolo effect when the guitar is played. In addition, the bridge unit 14 and the improved tuning machine 18 cooperatively define improved tuning adjustment mechanisms for facilitated tuning of the strings 12 and for rapid adjustment of the guitar between a plurality of preset tuning configurations.

The illustrative guitar 10 comprises a so called electric guitar of the type having a solid guitar body 16, although it will be understood that the invention may be used with other conventional guitar styles. The guitar body 16, as is conventional in the art, is connected at one end to an elongated neck 24 which in turn supports the head 20. The plurality of strings 12 are supported under tension to extend between the tuning machine 18 and the bridge unit 14, With the strings 12 extending in close overlying relation with a fingerboard 26 on the guitar neck 24. When the strings 12 are plucked or strummed, the vibrations of the strings are detected by one of two electromagnetic pickup units 27 and 28 on the guitar body, in accordance with the setting of a switch 29. These pickup units are electrically coupled in turn to an audio output jack 30 for connection to an appropriate amplifier (not shown) for converting the detected vibration signals to an audio output. Volume and tone controls 31, 31' and 32, 32' are normally provided in respective association with the two pickup units 27 and 28.

As known in the art, the guitar strings 12 are supported under different tension forces and typically have different string gauges to provide diffferent musical pitch outputs when the strings are plucked or strummed individually or as a group. The improved tuning machine 18 of the present invention advantageously facilitates accurate and individual string tensioning on an independent basis, whereby the tension of one string does not impact the tension or musical output of any other string. The improved tuning machine 18 thus permits rapid initial tuning of all the guitar strings and further maintains the strings in this initial or primary tuning configuration. The guitar may then be played in a normal manner to produce a range of notes and/or chords which can be varied by the musician by manually pressing selected strings 12 against the fingerboard 26 at selected positions between longitudinally spaced frets 33 to vary the effective lengths of the strings and the resultant pitch of the output notes.

The improved tuning machine 18 of the present invention is shown in more detail in one preferred form in FIGS. 2–5. As shown, the tuning machine 18 includes a lower baseplate 34 adapted for secure attachment to the head 20 of a standard guitar without requiring additional holes to be formed therein, thereby permitting use of the tuning machine as a replacement item for existing guitars, if desired. More specifically, the baseplate is secured to the head 20 by connector bolts 36 (FIGS. 3 and 5) passed upwardly through the head 20 for reception into threaded openings 37 in the baseplate 34. Bushings 38 are normally provided to position and retain the bolts 36 passing through the head and further to seat the bolt heads in generally flush relation with the underside of the guitar head 20.

Figure 5:
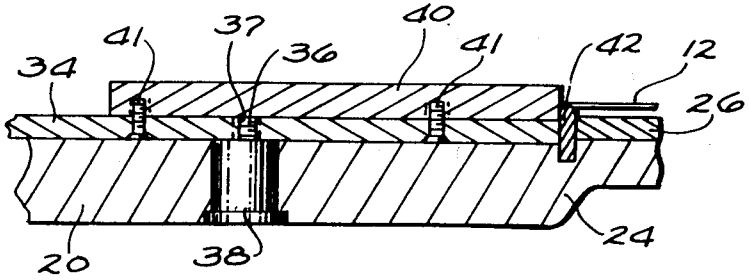
FIG. 5 is a fragmented longitudinal sectional view taken generally on the line 5—5 of FIG. 2.

The baseplate 34 of the improved tuning machine 18 in turn supports a generally U-shaped frame 40 secured thereto by screws 41 or other appropriate fastening means (FIG. 5). The frame 40 is supported in an orientation to open generally toward a nut 42 at the upper end of the guitar neck 24, with the individual strings 12 passing over the nut 42 extending further for individual wrapping about closely positioned and aligned capstans 44 respectively at the ends of a plurality of side-by-side slide blocks 46 captured within the interior of the U-shaped frame 40. From the capstans 44, the strings extend to wrapped relation beneath the heads of anchoring screws 48 threaded into the tops of the slide blocks 46 to lock the upper ends of the strings 12 in place. Conveniently, as shown best in FIGS. 2 and 4, these anchoring screws 48 may comprise easily grasped thumb screws in staggered relation to one another to permit rapid attachment or release of the strings without requiring additional tools. Alternately, or in addition, the anchoring screws 48 may include hexagonal sockets 48' for receiving the end of an appropriate wrench (not shown). Other alternative string fastening means will also be apparent to those skilled in the art.

The ends of the slide blocks 46 opposite the capstans 44 include longitudinally extending threaded bores 50 for individually receiving threaded adjustment screws 52. These threaded adjustment screws 52 project longitudinally from the slide blocks 46 for passage through smooth-bore openings 53 in a cross member 54 of the frame 40 and terminate in hexagonal socket heads 56 or the like at the outboard side of the cross member 54. Rotation of these adjustment screws on an individual basis is thus effective to shift the slide blocks 46 longitudinally within the frame 40 and with respect to the guitar neck 24 to correspondingly select the magnitude of tension force applied to each guitar string 12, with the opposite ends of the strings 12 being anchored at the bridge unit 14 as will be described herein in more detail. Importantly, the slide blocks permit the strings 12 to be anchored by the capstans 44 at positions very close to the nut 42, whereby relative string movement between the capstans and fret during tension adjustment is substantially minimized. As a result, string lock or clamp devices, sometimes referred to as nut locks, at the nut 42 can be eliminated.

Figure 6:
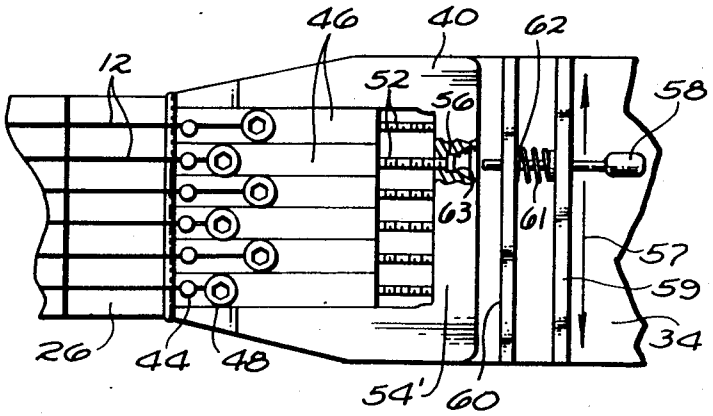
FIG. 6 is an enlarged fragmented top plan view similar to FIG. 2 but illustrating an alternative tuning machine construction.

An adjustment tool 58 shown in dotted lines in FIG. 4 may be inserted into the individual adjustment screw heads 56 to select the desired tension force for each guitar string. Alternately, as viewed in FIG. 6, the adjustment tool 58 can be mounted upon the baseplate 34 of the tuning machine 18 for transverse sliding motion along a pair of upstanding cross bars 59 and 60, as indicated by arrow 57 in FIG. 6. In this version, a spring 61 reacts between the cross bar 59 and a chip ring 62 on the tool shank to urge the tool toward engagement with one of the adjustment screw heads 56. As shown in FIG. 6, the screw heads 56 may be positioned at the bases of tapered conical recesses 63 in a modified frame cross member 54', wherein these recesses assist in guiding the spring-loaded tool shank into seated engagement with an aligned adjustment screw head.

Figure 7:
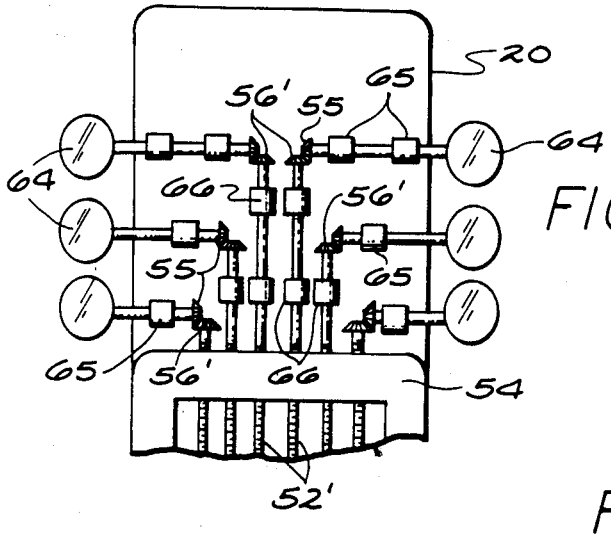
FIG. 7 is another fragmented top plan view similar to FIG. 2 and depicting a further alternative tuning machine construction.

In another alternative form of the tuning machine, as viewed in FIG. 7, modified adjustment screws 52' are provided to project through the frame cross member 54, with the exposed outboard ends of the screws 52' defining relatively small crown gears 56'. These crown gears 56' are engaged at right angles with mating crown gears 55 on the ends of rotatable adjustment keys 64. Support posts 65 conveniently retain the keys 64 with their crown gears 55 in engagement with their respective adjustment screws, with additional support posts 66 accommodating elongation of some of the screws 52' to achieve a staggered positioning of the associated crown gears 56' and staggered positioning of the keys 64. Rotation of the individual keys 64 results in longitudinal displacement of the associated slide blocks 46 (not shown in FIG. 7) to correspondingly achieve individual adjustment of the string tension.

Figure 8:
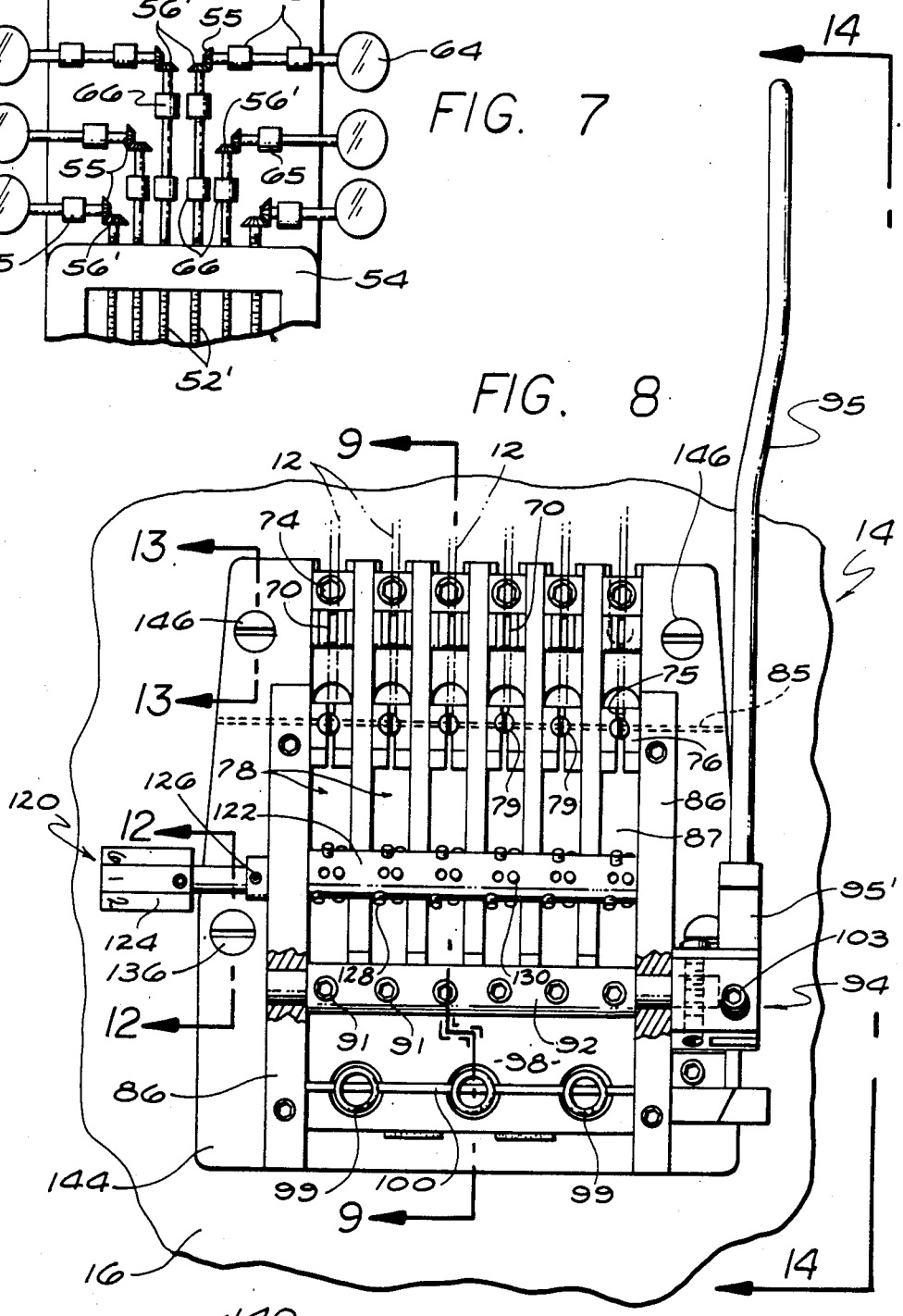
FIG. 8 is an enlarged fragmented top plan view of a bridge unit for the guitar, wherein the bridge unit incorporates the vibrato assembly and improved tuning adjustment mechanisms.

The opposite ends of the guitar strings 12 are supported by the bridge unit 14. More specifically, with reference to FIGS. 8 and 9, the strings are passed individually over respective saddle rollers 70 carried by short support posts 72 at one end of the bridge unit 14. These saddle rollers 70 conveniently define relatively low friction components for accommodating longitudinal displacement and tension adjustment of the strings during operation of the invention, as will be described in more detail. Conveniently, the posts 72 are adapted for at least some longitudinal adjustment capability along short tracks 73, to select the string intonation point with locking bolts 74 being provided to secure the saddle posts 72 in the selected positions of adjustment.

From the saddle rollers 70, the guitar strings pass through upwardly open slots 75 formed in upstanding forward legs 76 of individual, generally L-shaped rocker arms 78. A central support surface at the bottom of each slot 75 is defined by a tuning slug 79 threadably received into a threaded bore 80 in each rocker arm leg 76, wherein the tuning slug has a slotted upper end for easy screwdriver adjustment to correspondingly select the vertical position of the tuning slug 79. The strings 12 pass over the respective tuning slugs 79 and terminate in base ends secured by crimping or the like to retention balls 82 conveniently seated within rearwardly open notches 83 at the rear side of each upstanding rocker arm leg 76. Accordingly, the strings 12 are secured quickly, easily, and individually to the bridge unit for passage over the neck 24 to the tuning machine 18 for rapid and individualized tuning adjustment. In the event of string breakage, the tuning setting of the remaining strings is completely unaffected and a replacement string can be installed quickly and easily.

The rocker arms 78 are pivotally supported by the bridge unit 14 in side-by-side relation by a common pivot pin 85 extending between upstanding side rails 86 of the bridge unit. This pivot pin 85 extends through each of the rocker arms 78 generally at the juncture of the upstanding leg 76 and a rearwardly projecting lower leg 87. Accordingly, pivoting displacement of the rocker arms 78 about the pivot pin 85 results in at least some fore-aft displacement of the upper ends of the tuning slugs 79 to correspondingly alter the tension and resultant tuning setting of the strings 12. Importantly, in accordance with primary aspects of the invention, this pivoting movement of the rocker arms 78 is individually and variably controlled to expand the overall versatility and ease of operation of the guitar.

Figure 10:
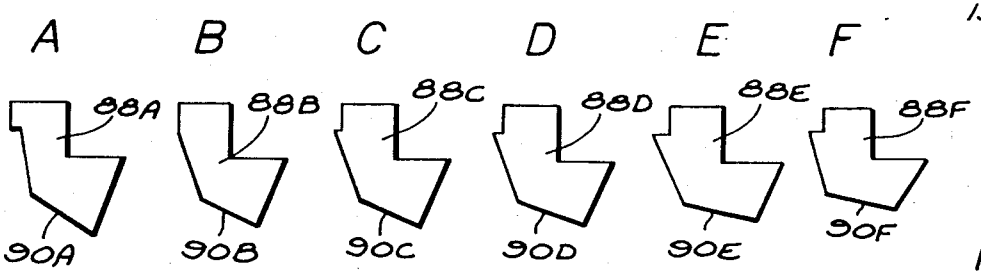
FIG. 10 is schematic diagram illustrating exemplary cams for use in the bridge unit of FIG. 9.
Figure 9:
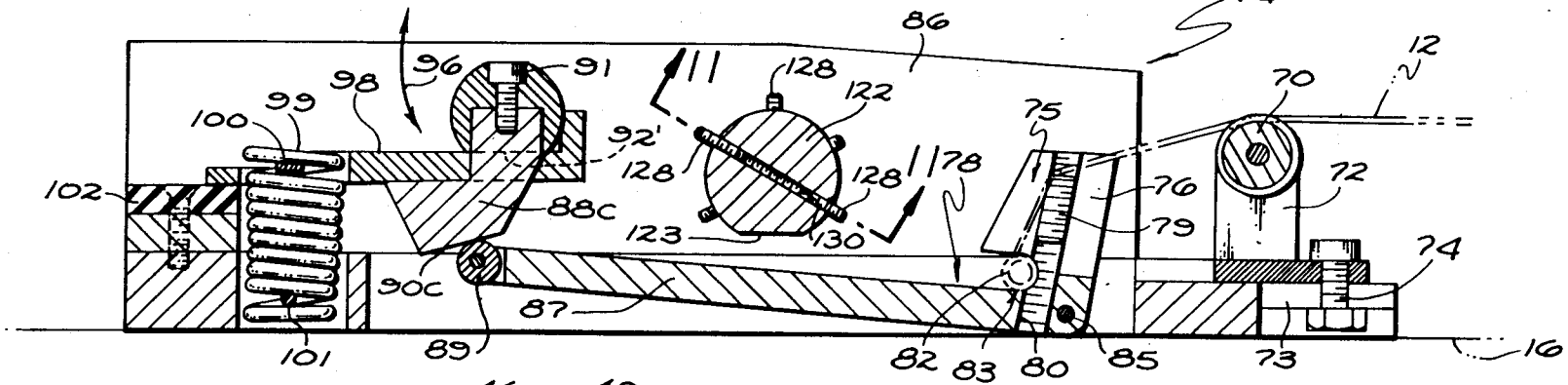
FIG. 9 is an enlarged fragmented longitudinal sectional view taken generally on the line 9—9 of FIG. 8.

As shown best in FIGS. 9 and 10, pivoting motion of the rocker arms is individually controlled by a corresponding plurality of cams 88A through 88F for respectively engaging the rearward ends of the rocker arm lower legs 87. More specifically, for minimized friction during operation, these legs 87 include cam follower rollers 89 at the rearward ends thereof in rolling contact engagement with cam faces 90A through 90F of the respective overlying cams 88A through 88F. These cams are supported by set screws 91 or the like from a control shaft 92 supported for rotation between the upstanding side rails 86 of the bridge unit 14.

One end of the control shaft 92 protrudes through the associated side rail 86 and is keyed or otherwise appropriately fastened to an outwardly projecting connector yoke 94 secured in turn to a generally longitudinally projecting control lever 95. Accordingly, movement of the control lever 95 toward or away from the guitar body 16 functions to rotate the control shaft 92 in a manner displacing the cams 88A–88F as indicated by arrow 96 in FIG. 9. Such cam movement effectively pivots the rocker arms 78 to obtain individualized displacement of the strings 12 and a corresponding individualized adjustment in string tension.

A retainer plate 98 is associated with the control shaft 92 and cooperates therewith to return the control shaft and the cams thereon to an initial or primary tuning set configuration when the control lever 95 is released. As viewed in FIG. 9, this retainer plate 98 includes a forward region engaged with a flat 92' on the underside of the control shaft. The plate 98 extends rearwardly from the shaft 92 and is coupled to the upper ends of a plurality of biasing springs 99 by means of a transverse retention bar 100. The lower ends of the springs 99 are anchored in place by a transverse pin 101 extending between the side rails 86.

Each time the control lever 95 is moved in a direction to decrease the tension of the guitar strings 12, the set of cams 88A–88F act to lift or pivot the rear portion of the retainer plate 98 to expand the lengths of the springs 99. Thus, when the lever 95 is released, the springs 99 return the entire assembly including the control lever 95 and the strings 12 to the initial or primary tuning set position. A rear margin of the retainer plate 98 seats upon a resilient stop 102 defining this primary tuning set position. When the lever 95 is moved in an opposite direction to increase tension on the strings 12, the string tension acts in a direction returning the assembly to the primary set position when the lever is released.

The above-described control shaft 92 and control lever 95 are operable by the musician as the vibrato assembly for controlled alteration of string tension to raise or lower output pitch, as desired. More specifically, the musician can press downwardly upon the control lever 95 to shift the set of cams in a direction permitting upward motion of the rollers 89 at the lower legs of the rocker arms 78. This effectively displaces the tuning slugs 79 and the strings 12 a short distance toward the guitar head 20 to decrease tension and thus lower the output pitch. Alternatively, lifting of the control lever 95 relative to the guitar body rotates the cams in a direction displacing the rocker arm lower legs 87 downwardly with resultant increase in string tension and raising of output pitch. When the lever 95 is released, the biasing springs 98 return the assembly to its initial primary tuning set position as discussed above whereby the lever 95 can be repeatedly depressed or repeatedly raised to achieve desired vibrato/tremolo effect. Importantly, the relative displacement for each rocker arm during control lever movement may differ as needed in accordance with cam face contour to maintain controlled relative pitch tuning between the various strings as the tensions thereof are altered.

In accordance with one further feature of the invention, the control lever 95 is securely pivoted onto the connector yoke 94 of the control shaft 92 substantially without lost motion. With this construction, raising or lowering of the control lever results in a direct and accurately controlled rotation of the control shaft 92. Incremental movement of the control lever thus corresponds with consistent pitch alteration as the guitar is played.

More specifically, as shown in FIGS. 14–16, the connector yoke 94 comprises a pair of spaced parallel plates 94' and 94'' defining an open slot therebetween for sliding reception of a matingly shaped end 95' of the control lever 95. This control lever end 95' has relatively flat upper and lower surfaces for substantial surface area contact with the inboard surfaces of the yoke arms 94' and 94''. A shoulder screw 103 passes downwardly through the upper yoke arm 94' and the control lever end 95' and has a threaded lower end fastened into a nut 104 seated against rotation within a hexagonal cavity 105 in the lower yoke arm 94''. Accordingly, the shoulder screw 103 permits relatively free swinging movement of the lever 95 about a pivot axis defined by the shoulder screw, with the captured nut 104 locked against rotation without working loose during swinging movement of the control lever. The connection between the yoke 94 and lever thus remains relatively secure, with the broad surface areas of contact therebetween preventing mechanical loss motion.

As shown in FIGS. 17 and 19, the connector yoke 94 accommodates swinging movement of the control lever 95 from the normal forwardly directed position to a rearwardly directed position where it can be locked in place to achieve alternative tuning configuration settings. More specifically, as shown in FIG. 17, the control lever 95 can be pivoted to a rearward position and then depressed for seating against a land 106 on the underside of a stop 108 projecting laterally from the adjacent side rail of the bridge unit 14. Such slight depression of the lever functions to rotate the control shaft 92 to increase string tension a selected amount, for example, an amount sufficient to elevate the pitch of each string by a predetermined magnitude such as one fret. The increased string tension reacts upon the control shaft in a manner to hold the lever securely against the land 106. As a result, the guitar is maintained in an alternative tuning configuration with string tension and resultant pitch increased.

Alternatively, as viewed in FIG. 19, the rearwardly directed control lever 95 can be raised against the forces applied by the biasing springs 98 to rest upon either of two vertically spaced lands 109 and 110 on top of the lateral stop 108. In these positions, the control shaft is thus rotated from the initial tuning set configuration to reduce string tension and thereby place the guitar in either of two additional tuning configurations. The precise positions of the lands 109 and 110 can be chosen to provide specific tuning configurations, such as raising the pitch of each string by one fret and two frets, respectively.

Additional alternative tuning configurations may be obtained by use of a selector dial unit 120 supported by the rails 86 in a position over the lower legs 87 of the rocker arms 78. More particularly, the selector dial unit 120 comprises a dial shaft 122 rotatably supported between the rails 86 and including one relatively flat facet 123. In a normal, inoperative position as viewed in FIG. 18, this flat facet 123 is presented downwardly toward the rocker arms 78 to permit uninterrupted pivoting thereof in response to control lever motion. This normal position is indicated by indicia such as the number "1" appearing on the periphery of a selector dial 124 on one outboard end of the shaft 122, wherein the selector dial 124 may be rotated to adjust the shaft to alternative tuning configurations. A spring-loaded detent ball 126 cooperates between the shaft 122 and the adjacent side rail 86 to releasably lock the shaft in one of the selected rotational positions, as viewed in FIG. 8.

The remaining facets of the selector dial shaft 122 are defined by transversely aligned rows of tuning selector or set pins 128 which are threadably received into threaded openings 130 formed in adjacent pairs over each of the rocker arm lower legs 87. These pairs of threaded openings 130, as shown in FIGS. 9 and 11, accommodate a pair of the set pins 128 projecting outwardly in diametrically opposite directions for engaging the rocker arm lower leg when the selector dial is rotated to orient a transverse row of pins to project downwardly. Importantly, for any position with the set pins engaging the rocker arms, an adjustment tool 132 shown in dotted lines in FIG. 11 can be inserted partially into the upwardly presented end of the opening 130 to adjust the projecting distance of the set pin.

Selector dial rotation can align any one of the rows of set pins 128 to project downwardly toward the underlying rocker arms 78. When this occurs, the control lever 95 can be pivoted to the rearwardly extending position and then locked on top of the stop 108, as viewed in FIGS. 19 and 20. Such locking of the lever 95 permits the rocker arms 78 to elevate into engagement with the downwardly projecting set pins 128. Accordingly, the set pins 128 retain the rocker arms and the associated strings in additional alternative tuning configuration settings, depending upon the selected position of dial rotation. Each of these tuning settings can be uniquely tailored by appropriate adjustment of the set pins, for example, by rotating the set pins 128 with the tool 132 (FIG. 11) while the output jack 30 of the guitar is coupled to a tuning meter (not shown).

Figure 12:
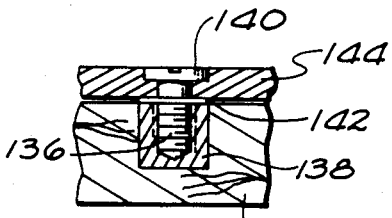
FIG. 12 is a fragmented vertical sectional view taken generally on the line 12—12 of FIG. 8.
Figure 13:
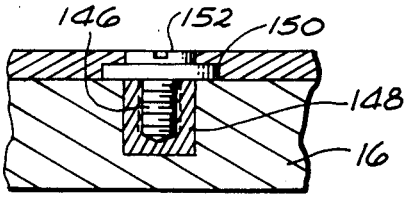
FIG. 13 is a fragmented vertical sectional view taken generally on the line 13—13 of FIG. 8.

In accordance with one further aspect of the invention, the bridge unit 14 is conveniently mounted on the guitar body 16 by mounting screws accommodating height adjustment of the strings relative to the guitar body. More specifically, as shown best in FIGS. 8, 12 and 13, rear mounting screws 136 are threaded into bushings 138 preinstalled at standarized positions in the guitar body. These mounting screws include countersunk enlarged heads 140 in spaced relation with radially enlarged retaining rings 142 installed onto the screws subsequent to screw passage through a base flange 144 of the bridge unit. Accordingly, rotation of the screws 136 within the bushings 138 effectively raises or lowers the height of the base flange 144 and thus raises or lowers the height of the bridge unit 14, in accordance with the direction of screw rotation.

Forward mounting screws 146 are similarly provided for passage through preformed openings in the bridge unit flanges 144 and threaded reception into bushings 148 in the guitar body 16. These forward screws 146, however, include modified heads having a radially enlarged lower head portion 150 and an upper head portion 152 of reduced size. Accordingly, counter clockwise rotation of the forward screws 146 within the bushings 148 is effective to elevate the forward end of the bridge unit 14 against the tension of the guitar strings. Clockwise screw rotation shifts the lower head portion downwardly toward the guitar body to permit the guitar strings to lower the position of the front portion of the bridge unit. The relative height of the strings above the guitar body can thus be selected to meet the preferences of the individual musician.

The illustrative guitar thus includes the improved vibrato assembly and tuning adjustment mechanisms for significantly enhancing the overall versatility of the guitar. These features are incorporated into the improved tuning machine 18 and the improved bridge unit 14, both of which can be installed as original equipment or mounted as an aftermarket item upon a guitar without requiring new mounting holes to be formed. The tuning machine and bridge unit accommodate rapid and independent string mounting and initial tuning at the primary tuning configuration. The individually adjusted tuning slugs 79 and the individual cams 88A–88F permit independently tailored string tension alteration during vibrato operation or rearward locking of the control lever 95 in alternative tuning configurations, with accurate, relatively frictionless spring-biased return of the strings to the primary set configuration when the control lever is released. Moreover, the lever 95 and/or the tuning selector dial unit 120 provide a number of preset alternative tuning setups which can be selected rapidly to permit an inexperienced musician to play music in many different keys. Once again, however, return adjustment of the guitar to the primary tuning configuration is accomplished quickly and easily, with accurate tuning retention.

A wide variety of further modifications and improvements to the invention described herein are believed to be apparent to those of ordinary skill in the art. Accordingly, no limitation on the invention is intended by way of the description and drawings, except as set forth in appended claims.

What is claimed is:

1. A guitar, comprising:

a guitar body;

an elongated neck projecting from said body and supporting a head generally at the distal end of said neck;

a tuning machine on said head;

a bridge unit on said body; and a plurality of strings supported under tension between said tuning machine and said bridge unit;

each of said tuning machine and said bridge unit including means for individually and independently supporting said guitar strings, said tuning machine further including means for individually and independently adjustably selecting the tension force applied to each of said strings;

said bridged unit including a plurality of generally L-shaped rocker arms each having a forward generally upstanding leg and a lower leg extending generally rearwardly from said forward leg in a direction away from said neck, means for supporting said rocker arms for pivoting movement about a pivot axis extending generally transversely through the junctures of said forward and lower legs, said strings being respectively seated upon the upper ends of said forward legs whereby pivoting movement of said rocker arms displaces said forward leg upper ends generally longitudinally relative to said neck to alter the tension forces applied to said strings, and pivot means on said bridge unit for controllably pivotably moving said rocker arms;

said pivot means comprising a plurality of separate cams respectively engaging the rear ends of said lower rocker arm legs, and means for displacing said cams relative to said rocker arms; and said cam displacing means comprising a control shaft rotatably supported by said bridge unit and carrying said cams, a control lever at one end of said control shaft for manually rotating said control shaft to displace said cams relative to said rocker arms, and spring means for returning said control lever and control shaft to an initial primary tuning set position when said control lever is released.

2. The guitar of claim 1 wherein said bridge unit further includes saddle rollers for respectively supporting said strings at a position between said rocker arms and said neck, said saddle rollers including means for selectively adjusting the longitudinal positions thereof relative to said neck.

3. The guitar of claim 1 wherein each of said rocker arm forward legs includes a longitudinally open slot with the base of said slot being defined by a generally vertically adjustable tuning slug, said strings being vertically supported by said tuning slugs of said rocker arm forward legs.

4. The guitar of claim 3 wherein said strings are respectively connected to enlarged balls at the ends thereof at said bridge unit, said balls being removably seated respectively within rearwardly open notches defined by said rocker arms.

5. The guitar of claim 1 wherein said rear ends of said rocker arm lower legs include cam follower rollers in respective engagement with said cams.

6. The guitar of claim 1 wherein said one end of said control shaft is defined by a connector yoke having a pair of spaced apart, generally parallel plates, said control lever having one end for mating reception between said plates, a shoulder screw received through one of said plates and said one end of said lever and threaded into a nut captured against rotation by the other of said plates.

7. The guitar of claim 6 wherein said control lever is swingable relative to said yoke between a forwardly projecting position and a rearwardly projecting position, said lever being movable toward and away from said guitar body in either one of said forward and rearward positions to rotate said control shaft.

8. The guitar of claim 7 wherein said bridge unit further includes a locking stop for releasably retaining said control lever in at least one position with the control shaft rotated from said primary tuning set position to an alternative tuning configuration when said control lever is in said rearwardly projecting position.

9. The guitar of claim 1 further including a tuning selector dial unit mounted on said bridge unit and including a selector dial shaft rotatably disposed over said rocker arm lower legs, said dial shaft having a plurality of transverse rows of tuning set pins for engaging respectively said rocker arm lower legs when a selected one of said rows is oriented to project toward said lower legs to limit pivoting movement of said rocker arms.

10. The guitar of claim 9 wherein said dial unit includes a selector dial with indicia indicating the rotational position of said dial shaft.

11. The guitar of claim 9 wherein said dial shaft includes at least one blank facet wherein none of said tuning set pins project toward said rocker arm lower legs.

12. The guitar of claim 9 wherein said tuning set pins are adjustably supported by said dial shaft.

13. The guitar of claim 9 wherein said bridge unit further includes means for pivoting said rocker arms to displace the lower legs thereof into seated and locked engagement with a selected row of said tuning set pins, whereby the guitar can be placed into a selected one of a plurality of alternative tuning configurations.

14. The guitar of claim 1 further including means for adjustably mounting said bridge unit on said body to vary the height of said strings relative to said body.

15. A guitar, comprising:

a guitar body;

an elongated neck projecting from said body and supporting a head generally at the distal end of said neck;

a plurality of strings;

a tuning machine on said head and a bridge unit on said body and including a plurality of generally L-shaped rocker arms each having a forward generally upstanding leg and a lower leg extending generally rearwardly from said forward leg in a direction away from said neck, means for supporting said rocker arms for pivoting movement about a pivot axis extending generally transversely through the junctures of said forward and lower legs, said strings being respectively seated upon the upper ends of said forward legs whereby pivoting movement of said rocker arms displaces said forward legs upper ends generally longitudinally relative to said neck to alter the tension forces applied to said strings, and pivot means on said bridge unit for controllably pivotably moving said rocker arms;

said pivot means comprising a plurality of separate cams respectively engaging the rear ends of said lower rocker arm legs, and means for displacing said cams relative to said rocker arms;

said displacing means comprising a control shaft rotatably supported by said bridge unit and carrying said cams, a control lever at one end of said control shaft for manually rotating said control shaft to displace said cams relative to said rocker arms, and spring means for returning said control lever and control shaft to an initial primary tuning set position when said control lever is released.

16. The guitar of claim 15 wherein each of said rocker arm forward legs includes a longitudinally open slot with the base of said slot being defined by a generally vertically adjustable tuning slug, said strings being vertically supported by said tuning slugs of said rocker arm forward legs.

17. The guitar of claim 16 wherein said strings are respectively connected to enlarged balls at the ends thereof at said bridge unit, said balls being removably seated respectively within rearwardly open notches defined by said rocker arms.

18. In a guitar having a body, a neck, a head at a distal end of the neck, a plurality of strings, and a tuning machine for supporting the strings relative to the head, an improved bridge unit, comprising;

a plurality of generally L-shaped rocker arms each having a forward generally upstanding leg and a lower leg extending generally rearwardly from said forward leg in a direction away from said neck;

means for pivotally supporting said rocker arms relative to said body for pivoting movement about a pivot axis extending generally transversely through the junctures of said forward and lower legs, said strings being respectively seated upon the upper ends of said forward legs whereby pivoting movement of said rocker arms displaces said forward leg upper ends generally longitudinally relative to said neck to alter tension forces applied to said strings;

means for removably securing said strings to said rocker arms; and pivot means for controllably pivoting said rocker arms through individually selected increments, said pivot means comprising a plurality of separate cams respectively engaging the rear ends of said lower rocket arm legs, and means for displacing said cams relative to said rocker arms;

said displacing means comprising a control shaft rotatably supported by said bridge unit and carrying said cams, a control lever at one end of said control shaft for manually rotating said control shaft to displace said cams relative to said rocker arms, and spring means for returning said control lever and control shaft to an initial primary tuning set position when said control lever is released.

19. The bridge unit of claim 18 wherein said bridge unit further includes saddle rollers for respectively supporting said strings at a position between said roller arms and said neck, said saddle rollers including means for selectively adjusting the longitudinal positions thereof relative to said neck.

20. The bridge unit of claim 18 wherein each of said rocker arm forward legs includes a longitudinally open slot with the base of said slot being defined by a generally vertically adjustable tuning slug, said strings being vertically supported by said tuning slugs of said rocker arm forward legs.

21. The bridge unit of claim 20 wherein said strings are respectively connected to enlarged balls at the ends thereof at said bridge unit, said balls being removably seated respectively within rearwardly open notches defined by said rocker arms.

22. The bridge unit of claim 18 wherein said rear ends of said rocker arm lower legs include cam follower rollers in respective engagement with said cams.

* * * * *

UNITED STATES PATENT AND TRADEMARK OFFICE

CERTIFICATE OF CORRECTION

PATENT NO. : 4,686,883

DATED : August 18, 1987

INVENTOR(S) : Roland J. Piche and John W. Carruthers

It is certified that error appears in the above-identified patent and that said Letters Patent is hereby corrected as shown below:

In Column 3, line 49, delete the word "the" and insert therefor --this--.

In Column 12, line 64, add a ";" after the word "head."

In Column 14, line 16, delete the word "rocket" and insert therefor --rocker--.

Signed and Sealed this

Eighth Day of March, 1988

*Attest:*

DONALD J. QUIGG

*Attesting Officer*

*Commissioner of Patents and Trademarks*